US009163421B2

(12) United States Patent
Van Der Meijden et al.

(10) Patent No.: US 9,163,421 B2
(45) Date of Patent: Oct. 20, 2015

(54) IDLER MECHANISMS FOR HYDRAULIC DEVICES

(75) Inventors: Hendrikus Johannes Van Der Meijden, Midrand (ZA); Bruce David Harbottle, Johannesburg (ZA); Dindo Uy, North Hollywood, CA (US); Eusebio Bareng, Oxnard, CA (US); Scott Yankie, Simi Valley, CA (US)

(73) Assignee: ZODIAC POOL SYSTEMS, INC., Vista, CA (US)

( * ) Notice: Subject to any disclaimer, the term of this patent is extended or adjusted under 35 U.S.C. 154(b) by 668 days.

(21) Appl. No.: 13/049,029

(22) Filed: Mar. 16, 2011

(65) Prior Publication Data

US 2011/0226361 A1 Sep. 22, 2011

Related U.S. Application Data

(60) Provisional application No. 61/340,353, filed on Mar. 16, 2010, provisional application No. 61/406,589, filed on Oct. 26, 2010.

(51) Int. Cl.
*E04H 4/00* (2006.01)
*E04H 4/16* (2006.01)

(52) U.S. Cl.
CPC ..... *E04H 4/1654* (2013.01); *Y10T 137/85986* (2015.04)

(58) Field of Classification Search
USPC ..... 4/490; 15/1.7; 251/114, 89; 137/18
See application file for complete search history.

(56) References Cited

U.S. PATENT DOCUMENTS

| | | | | |
|---|---|---|---|---|
| 716,650 | A | 12/1902 | Wheeler et al. | |
| 2,436,683 | A | 2/1948 | Wood, Jr. | |
| 3,750,001 | A | 7/1973 | McCloskey | |
| 3,845,291 | A | 10/1974 | Portyrata | |
| 4,246,753 | A | 1/1981 | Redmond | |
| 4,272,686 | A | 6/1981 | Suzuki | |
| 4,352,025 | A | 9/1982 | Troyen | |
| 4,408,127 | A | 10/1983 | Santos, Sr. | |
| 4,616,298 | A | 10/1986 | Bolson | |
| 4,742,593 | A | 5/1988 | Kallenbach | |
| RE32,870 | E * | 2/1989 | Houston et al. | 137/430 |

(Continued)

FOREIGN PATENT DOCUMENTS

| | | |
|---|---|---|
| AU | 649515 | 8/1992 |
| DE | 19808328 | 9/1999 |

(Continued)

OTHER PUBLICATIONS

International Search Report and Written Opinion dated Jun. 21, 2011 in related Application No. PCT/US2011/028593.

(Continued)

*Primary Examiner* — Lauren Crane
(74) *Attorney, Agent, or Firm* — Dean W. Russell, Esq.; Kilpatrick Townsend & Stockton LLP

(57) ABSTRACT

Devices and methods for inhibiting movement of automatic pool cleaners (APCs) are described. Versions of the devices may cause pool water to bypass flowing through bodies of APCs. Alternatively, they may cause water flowing though bodies of APCs to bypass the associated motive force creators. The devices thus may constitute idler mechanisms, as they effectively prevent movement without requiring operation of the ultimate driver (i.e. the pump) to cease.

9 Claims, 3 Drawing Sheets

(56) References Cited

U.S. PATENT DOCUMENTS

| | | | | |
|---|---|---|---|---|
| 4,918,369 | A | 4/1990 | Solorow | |
| 5,228,964 | A | 7/1993 | Middleby | |
| 5,465,443 | A | 11/1995 | Rice et al. | |
| 5,720,068 | A | 2/1998 | Clark et al. | |
| 5,904,171 | A * | 5/1999 | Stahle et al. | 137/114 |
| 6,125,492 | A | 10/2000 | Prowse | |
| 6,484,743 | B2 | 11/2002 | Bauckman | |
| 6,798,080 | B1 | 9/2004 | Baarman et al. | |
| 6,864,591 | B2 | 3/2005 | DeFrank | |
| 6,981,650 | B2 | 1/2006 | Uy et al. | |
| 7,019,411 | B2 | 3/2006 | Satou et al. | |
| 7,036,951 | B2 | 5/2006 | St-Hilaire | |
| 7,067,936 | B2 | 6/2006 | Baarman et al. | |
| 7,117,554 | B2 | 10/2006 | Pichon | |
| 7,233,078 | B2 * | 6/2007 | Baarman et al. | 290/43 |
| 7,284,565 | B2 * | 10/2007 | Sebor | 137/114 |
| 7,357,599 | B2 | 4/2008 | Cripps | |
| 7,398,138 | B2 | 7/2008 | Emery et al. | |
| 8,092,675 | B2 | 1/2012 | Kennedy | |
| 2005/0248161 | A1 | 11/2005 | Heidel | |
| 2008/0189885 | A1 * | 8/2008 | Erlich et al. | 15/1.7 |
| 2011/0064626 | A1 | 3/2011 | Kennedy | |
| 2011/0226361 | A1 | 9/2011 | Van Der Meijden et al. | |
| 2012/0110727 | A1 | 5/2012 | Uy et al. | |

FOREIGN PATENT DOCUMENTS

| | | |
|---|---|---|
| EP | 1348913 | 10/2003 |
| EP | 1553356 | 7/2005 |
| WO | WO0155589 | 8/2001 |
| WO | 2009104020 | 8/2009 |
| WO | 2011116046 | 9/2011 |

OTHER PUBLICATIONS

International Preliminary Report on Patentability dated May 10, 2013 in Application No. PCT/US2011/051683.

International Preliminary Report on Patentability dated Sep. 27, 2012 in Application No. PCT/US2011/028593.

Communication Relating to the Results of the Partial International Search Report dated Jan. 3, 2012 in Application No. PCT/US2011/051683.

International Search Report and Written Opinion dated Mar. 7, 2012 in Application No. PCT/US2011/051683.

* cited by examiner

IDLER MECHANISMS FOR HYDRAULIC DEVICES

CROSS-REFERENCE TO RELATED APPLICATION

This application claims the benefit of U.S. Provisional Application No. 61/340,353, filed Mar. 16, 2010, and of U.S. Provisional Application No. 61/406,589, filed Oct. 26, 2010.

FIELD OF THE INVENTION

This invention relates to mechanisms for idling hydraulic devices and more particularly, although not necessarily exclusively, to apparatus for idling operation of automatic swimming pool cleaners.

BACKGROUND OF THE INVENTION

U.S. Pat. No. 4,742,593 to Kallenbach depicts an exemplary "suction-side" type of hydraulic automatic pool cleaner (APC). The cleaner includes an operating head, or body, together with a foot functioning as a bearing surface (among other things). Typically connected to the foot is a disc, examples of which are illustrated in U.S. Pat. No. 5,465,443 to Rice, et al. An outlet of the body normally communicates with a hose and thence to the inlet (i.e. the "suction side") of a pump of a water-recirculation system associated with a swimming pool. Operation of the pump tends to evacuate the body, drawing debris-laden water from the pool into the body and thereafter into the hose. Located either within the body or remote therefrom, a mechanical filter typically strains the water before it encounters the inlet of the pump.

Present within the body is a valve designed periodically to interrupt the flow of water through the body. This periodic interruption of flow produces a water-hammer effect resulting in movement of the cleaner about the pool. Alternatively, flow through the body may operate a turbine or other device designed to drive wheels of a cleaner.

U.S. Pat. No. 5,720,068 to Clark, et al. illustrates an exemplary "pressure-side" hydraulic APC. It too comprises a body communicating via a hose with a pump, albeit with the outlet (i.e. "pressure side") of the pump rather than with its inlet. Pressurized water (jets) exiting the body functions to move the cleaner within the pool; exploiting the Venturi principle, it also creates a low pressure region within the body for drawing pool water therein.

Both suction-side and pressure-side APCs are configured to move when connected to an operating pump. In other words, the relevant motive force creator (water-interruption valve, turbine, jet, etc.) is designed, conventionally, to be operational whenever the APC is communicating with the pump and the pump is activated. At times, though, it may be advantageous to cease movement of a cleaner without necessarily disconnecting it from or deactivating the pump. For example, if activities are occurring in one area of a pool, disabling a cleaner so as to prevent its movement into that area could be beneficial. As another example, if the pump is connected as well to some other object, reducing the force required to move the cleaner permits more pump force to be available for application to the other object.

DESCRIPTION OF THE INVENTION

The present invention provides means for inhibiting movement of an APC. Versions of the invention may cause pool water to bypass flowing through bodies of APCs. Alternatively, they may cause water flowing though bodies of APCs to bypass the associated motive force creators. In this sense the invention may constitute idler mechanisms, as they effectively prevent movement without requiring operation of the ultimate driver (i.e. the pump) to cease.

Figure 1:
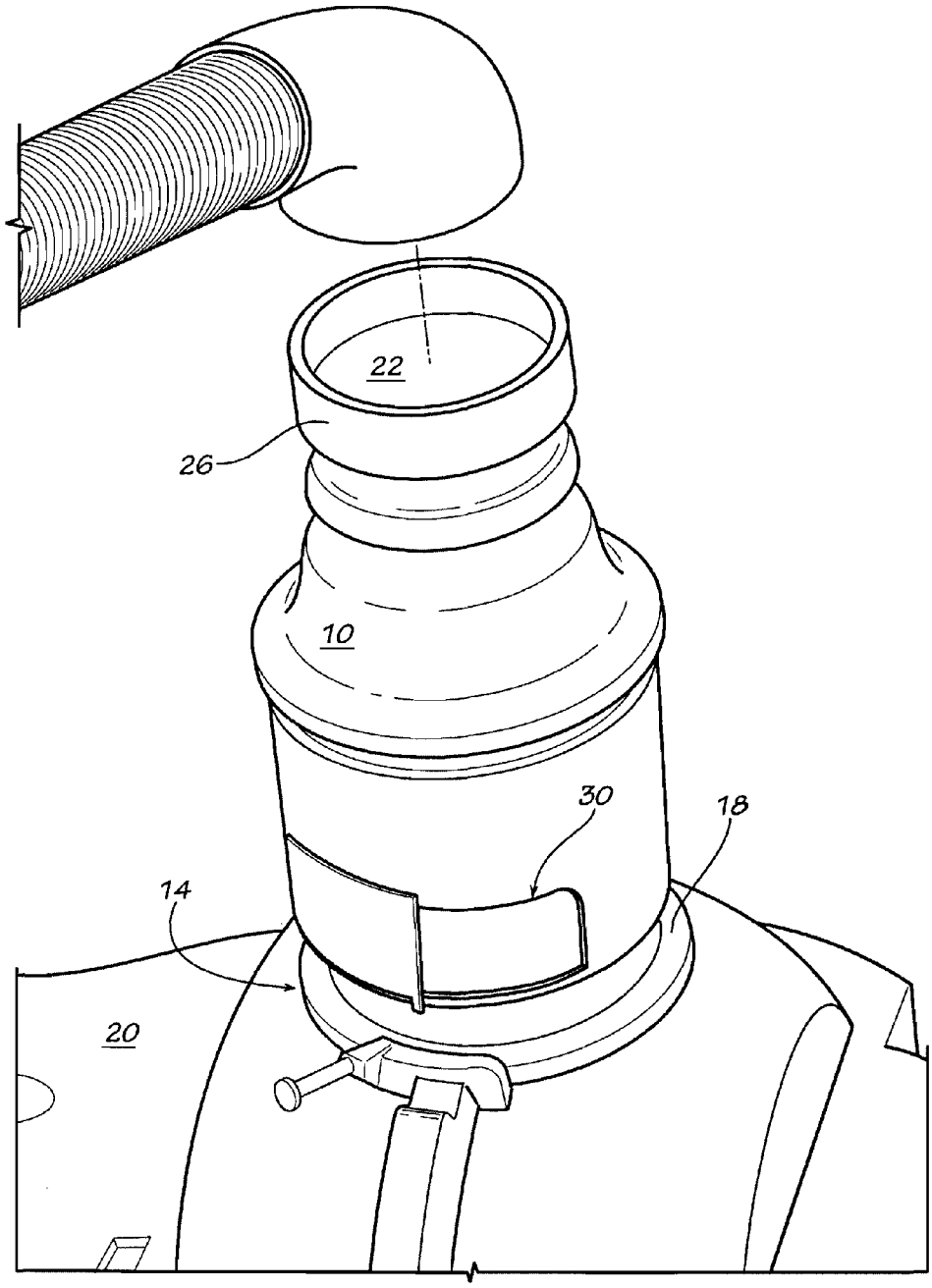
FIG. 1 illustrates an exemplary idler mechanism of the present invention.

FIG. 1 illustrates exemplary idler mechanism 10. Mechanism 10, as depicted, is configured as an interface unit for positioning between a hose and a body of an APC. First opening 14, at (nominally) lower end 18 of mechanism 10, typically connects to an APC 20. Second opening 22, at (nominally) upper end 26 of mechanism 10, usually connects to a hose. Mechanism 10 thus may be external to both an APC and a hose, facilitating its use for retrofitting existing systems. Alternatively, however, mechanism 10 may be incorporated into either or both of the APC or the hose. Yet alternatively, mechanism 10 may be incorporated into or connected to any of a weir, skimmer, suction or pressure line, or otherwise as appropriate or desired.

Also shown as defined by mechanism 10 is third opening 30. Third opening 30 is located between first and second openings 14 and 18 and preferably is a discontinuity in a wall of mechanism 10. It further may be opened and closed as desired by any suitable means. When third opening 30 is closed, mechanism 10 is essentially merely a continuation of the hose or cleaner, and water flowing from one to the other may pass through mechanism 10 unabated. By contrast, when third opening 30 is open, water may enter and exit mechanism 10 through the third opening 30 rather than (or in addition to) inlet and outlets of the APC and hose. Third opening 30 thus functions as a by-pass port when open.

Assuming mechanism 10 is used in connection with a suction-side APC, first opening 14 will be connected to an outlet of the APC and second opening 22 will be connected to an inlet of a hose whose outlet communicates with an inlet of a pump. When third opening 30 is closed, action of the pump draws pool water into and through the body, thereby causing the APC to move. However, should third opening 30 be opened, the pump will draw most (if not all) of its water directly from the pool, bypassing the body of the APC. In this instance, fluid flow through the body will be insufficient to create any substantial movement of the cleaner.

Assuming, alternatively, that mechanism 10 is used in connection with a pressure-side APC, first opening 14 will connect to an inlet of the APC and second opening 14 will be connected to an outlet of a hose. When third opening 30 is closed, water may flow through mechanism 10 from the hose into the APC. When third opening 30 is opened, however, water flows from the hose directly into the pool, again bypassing the APC and thereby preventing significant movement thereof.

One of various means for opening and closing third opening 30 is an assembly comprising a door and magnets. In one exemplary version of the invention, the door may travel in grooves to a first position closing third opening 30. Attached to the door may be a first magnet whose polarity is such that it is attracted to a second magnet attached within the wall of mechanism 10 remote from the first position. Manual force may be used to move the door to a second position opening third opening 30 and in which the first and second magnets are sufficiently proximate to allow their attractive forces to retain the door in the second position. When desired to return the door to the first position, manual force again may be used to overcome the attractive magnetic forces. Of course, persons skilled in the relevant fields will be aware that many other means and assemblies may be used instead to open and close third opening 30.

Illustrated in FIGS. 2-5 is alternate exemplary mechanism or device 10' of the present invention. As depicted in these figures, device 10' too is configured for attachment in-line to hoses, pipes, or other conduits for fluid or otherwise as appropriate or desired. Device 10' thus includes inlet 14' and outlet 18', with inlet 14' typically (although not necessarily) being connected via hose to a suction-side APC and outlet 18' typically (although again not necessarily) being connected via hose to an inlet of a pump. Device 10' could, of course, be configured or reconfigured for use with a pressure-side APC.

Figure 2:
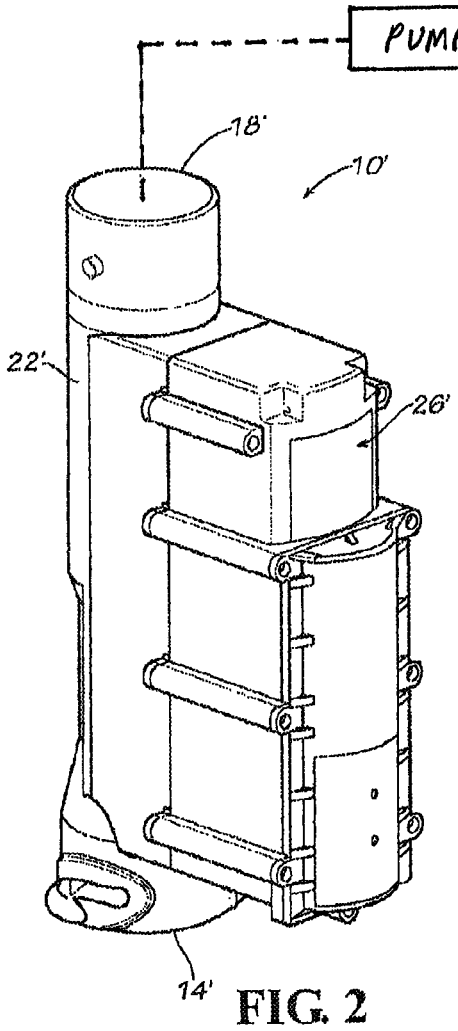
FIG. 2 depicts a second exemplary idler mechanism of the present invention.
Figure 3:
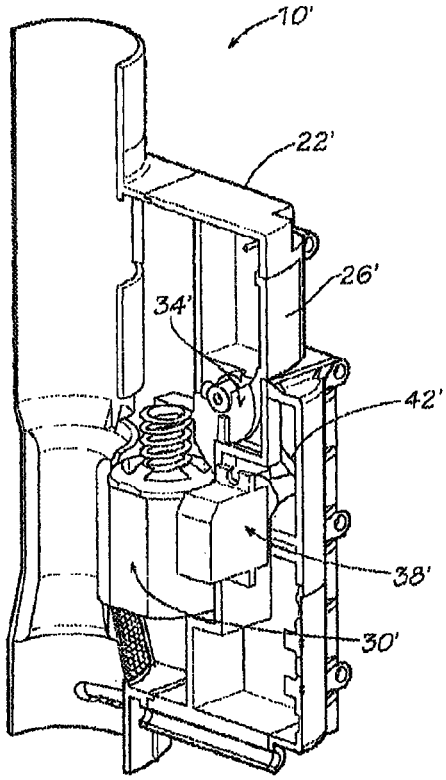
FIGS. 3-5 are cut-away views of the device of FIG. 2.
Figure 4:
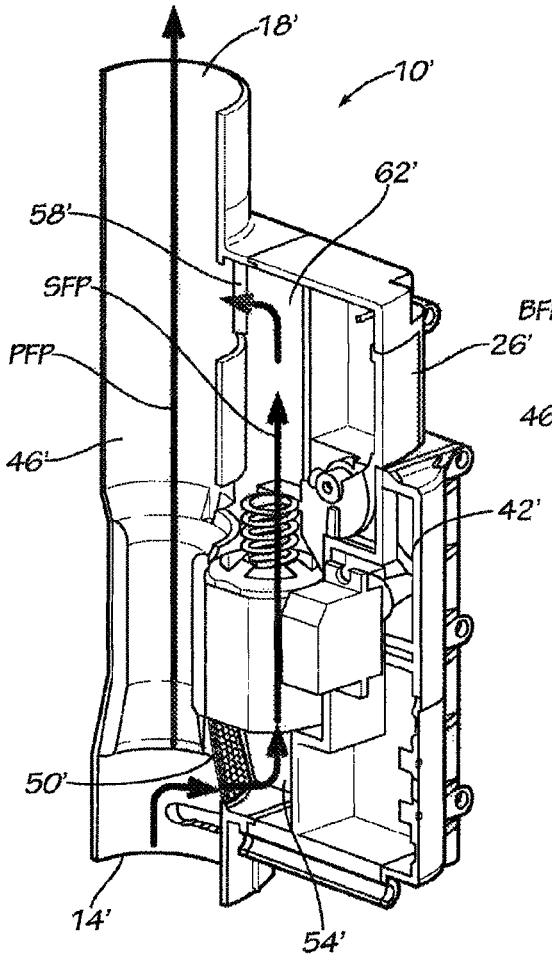

Also included as part of device 10' is housing 22'. The housing 22' may be made of any suitable material and comprise any number of components; preferably, however, housing 22' is molded of plastic material into a single unit. Connected to housing 22' may be a barrier in the form of valve or door 26' (or otherwise). When door 26' is closed (as shown in FIGS. 2-4), fluid enters and exits device 10' only through inlet 14' and outlet 18'. By contrast, when door 26' is open, fluid may enter device 10' also through the door 26'.

Figure 5:
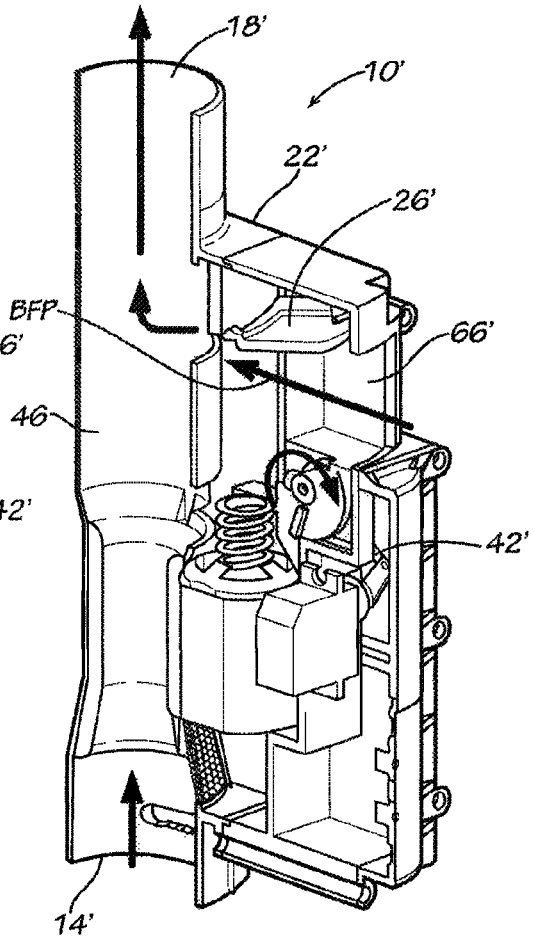

Depicted in FIGS. 3-5 are turbine generator 30', latch 34', and latch actuator 38'. Generator 30' may be any suitable such device, including those discussed in U.S. patent application Ser. No. 12/244,083 of Kennedy. One acceptable version of generator 30' is a commercially-available device used to illuminate LEDs in a shower head. Electricity generated by generator 30' may operate (electric) actuator 38' so as to rotate latch 34'. Depending on its rotational position, latch 34' either allows door 26' to pivot (and thus open) under influence of a pump, as shown in FIG. 5, or prevents the door 26' from pivoting (thus remaining closed) as shown in FIGS. 2-4, with spring 42' serving to bias latch 34' so that door 26' normally is closed. Persons skilled in the art will, of course, recognize that other types of actuators and latches may be used instead; indeed, any electrically-operated device that can cause a valve to open and close on a defined or random schedule may be appropriate in some versions of device 10'.

Exemplary flow through device 10' when door 26' is closed is depicted in FIG. 4. With door 26' closed, fluid (e.g. water) under influence of a pump enters device 10' solely through inlet 14'. The majority of the entering fluid flows through first pathway 46' directly to outlet 18'. First pathway 46' preferably is tubular and not substantially more restrictive to flow than are the hoses to which device 10' is attached. Accordingly, first pathway 46' forms a generally unobstructed routing from inlet 14' to outlet 18' and thus comprises part of the primary flow path PFP through device 10'.

Secondary flow path SFP also exists within device 10'. As currently configured, device 10' accepts a fraction of the fluid flowing through inlet 14' into secondary flow path SFP via filter 50' and secondary inlet 54'. This fraction of diverted fluid then encounters turbine generator 30', causing generator 30' to produce electricity, and thereafter passes through secondary outlet 58' for return to the primary flow path PFP for transit to outlet 18'. The region in which the diverted fluid travels between secondary inlet 54' and secondary outlet 58' forms second pathway 62'. At least because generator 30' is present therein (if not also because of its size and shape), second pathway 62' is more restrictive of fluid flow than is first pathway 46'.

When door 26' is open, as in FIG. 5, fluid may enter device 10' via bypass inlet 66'. Such fluid may then travel generally unobstructed through secondary outlet 58' to outlet 18', thus in a bypass flow path BFP. However, because bypass flow path BFP is generally unobstructed and of shorter distance than is primary flow path PFP, the majority of fluid entering device 10' will do so via bypass inlet 66', thus reducing the draw of fluid through inlet 14'. This reduced draw in turn reduces fluid drawn into a connected APC, preferably to below a level at which it is operational.

The foregoing is provided for purposes of illustrating, explaining, and describing embodiments of the present invention. Modifications and adaptations to these embodiments will be apparent to those skilled in the art and may be made without departing from the scope or spirit of the invention. The contents of the Kallenbach and Clark patents and the Kennedy application are incorporated herein in their entireties by this reference.

What is claimed is:

1. An idler mechanism for a hydraulic device configured to be deployed in water of a swimming pool or spa, which water circulates under influence of a pump, comprising:

a. a housing (i) comprising (A) a first opening configured in use for fluid communication with the hydraulic device, (B) a second opening configured in use for fluid communication with means for causing fluid to flow to or from the hydraulic device, and (C) a third opening and (ii) defining in use a primary fluid flow path between the first and second openings;

b. a barrier configured in use to (i) be in contact with water of the swimming pool or spa and (ii) move between (A) a closed position in which water of the swimming pool or spa may not enter the third opening and (B) an at least partially open position in which water of the swimming pool or spa may enter the third opening; and c. a latch for keeping the barrier in the closed position regardless of the rate of fluid flow in the primary flow path.

2. An idler mechanism according to claim 1 in which the barrier comprises a door.

3. An idler mechanism according to claim 1 further comprising a latch actuator.

4. An idler mechanism according to claim 3 further comprising a generator configured to supply electricity to the latch actuator.

5. An idler mechanism according to claim 4 in which the latch is configured to rotate.

6. An idler mechanism according to claim 1 in which the housing further comprises a first end at which the first opening is positioned and a second end at which the second opening is positioned.

7. A hydraulic cleaning system for a swimming pool or spa, comprising:

a. an automatic swimming pool cleaner configured for movement at least about a surface of the swimming pool or spa;

b. a pump configured to cause water to flow to or from the automatic swimming pool cleaner; and c. an idler mechanism (i) in fluid communication with the pump and the automatic swimming pool cleaner, (ii) defining a primary fluid flow path, and (iii) comprising (A) a housing having a bypass inlet, (B) a barrier in communication with water of the swimming pool or spa, and (C) a latch for keeping the barrier in a closed position regardless of the rate of fluid flow in the primary fluid flow path so that water of the swimming pool or spa may not enter the housing through the bypass inlet.

8. A method of idling movement of an automatic swimming pool cleaner without disabling an associated pump, comprising:

a. positioning an idler mechanism in fluid communication with the pump and the automatic swimming pool cleaner, the idler mechanism defining a primary fluid flow path and comprising a latch for keeping a barrier in a closed position regardless of the rate of fluid flow in the primary fluid flow path;

b. operating the pump to cause water to flow to or from the automatic swimming pool cleaner so as to effect movement of the automatic swimming pool cleaner within a swimming pool or spa; and c. automatically reconfiguring the idler mechanism so as to unlatch the barrier and allow the barrier to move to an at least partially open position, thereby ceasing the movement of the automatic swimming pool cleaner within the swimming pool or spa notwithstanding continued operation of the pump.

9. A method according to claim 8 in which (a) operating the pump causes water to flow through the automatic swimming pool cleaner at a first rate and (b) automatically reconfiguring the idler mechanism reduces water flow through the automatic swimming pool cleaner to less than the first rate.

* * * * *